US008627750B2

(12) United States Patent
Ortiz

(10) Patent No.: US 8,627,750 B2
(45) Date of Patent: Jan. 14, 2014

(54) VACUUM SHROUD FOR FRANGIBLE COLLAR RETRIEVAL

(75) Inventor: Steven A. Ortiz, Lake Elsinore, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 301 days.

(21) Appl. No.: 13/211,099

(22) Filed: Aug. 16, 2011

(65) Prior Publication Data

US 2012/0186405 A1 Jul. 26, 2012

Related U.S. Application Data

(60) Provisional application No. 61/435,227, filed on Jan. 21, 2011.

(51) Int. Cl.
*B25B 23/02* (2006.01)

(52) U.S. Cl.
USPC ..... 81/180.1

(58) Field of Classification Search
USPC ..... 81/180.1, 184, 57.14, 57.3
See application file for complete search history.

(56) References Cited

U.S. PATENT DOCUMENTS

| | | | | |
|---|---|---|---|---|
| 847,596 | A | 3/1907 | McMurtry | |
| 2,611,289 | A | 9/1952 | Frank | |
| 3,126,021 | A * | 3/1964 | May | 451/456 |
| 3,602,071 | A * | 8/1971 | Juhasz | 81/57.14 |
| 4,593,583 | A * | 6/1986 | Singleton | 81/57.14 |
| 4,735,118 | A * | 4/1988 | Broemel, Jr. | 81/57.3 |
| 6,557,727 | B1 | 5/2003 | Robertson | |
| 6,634,261 | B1 | 10/2003 | Griffin | |

* cited by examiner

*Primary Examiner* — Hadi Shakeri
(74) *Attorney, Agent, or Firm* — Stetina Brunda Garred & Brucker

(57) ABSTRACT

A vacuum shroud is provided for receiving nuts separated from frangible collar fasteners by use of a powered offset ratchet head. The shroud comprises of an offset ratchet head receiving portion and a nut receiving portion. The offset ratchet head receiving portion defines an aperture formed to receive and engage the offset ratchet head. The nut receiving portion defines a nut receiving aperture and a nut discharge port. The nut receiving aperture is disposed adjacent to the offset ratchet head receiving aperture, to receive nuts discharged from the offset ratchet head when the ratchet head is disposed in the ratchet head receiving aperture. The shroud may further define a conduit extending from the nut receiving portion to the nut discharge port. The nut discharge port is engageable to a vacuum source to draw nuts received in the nut receiving portion out of the nut discharge port.

14 Claims, 7 Drawing Sheets

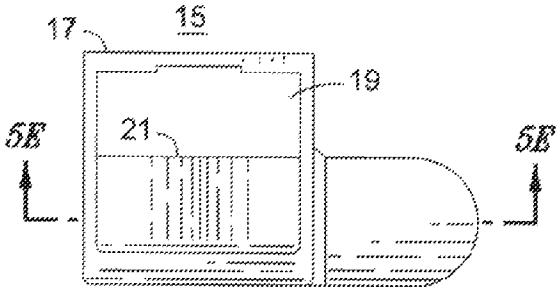
Fig. 5A
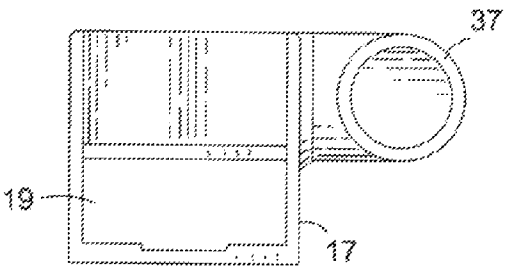
Fig. 5D
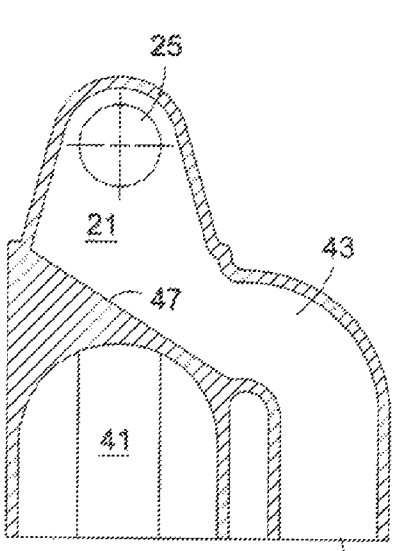
Fig. 5B
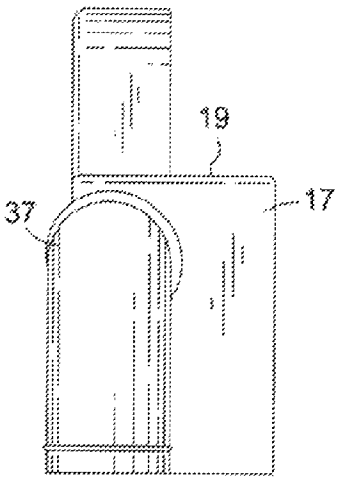
Fig. 5C
Fig. 5E
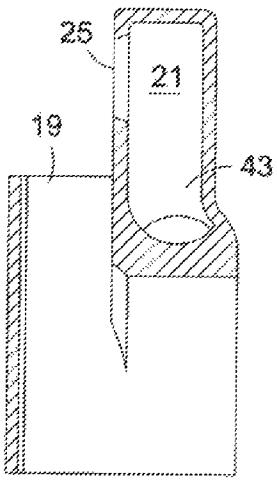
Fig. 5F

VACUUM SHROUD FOR FRANGIBLE COLLAR RETRIEVAL

CROSS-REFERENCE TO RELATED APPLICATIONS

This application claims priority to provisional application No. 61/435,227, filed on Jan. 21, 2011, for Vacuum Shroud For Frangible Collar Retrieval.

STATEMENT RE: FEDERALLY SPONSORED RESEARCH/DEVELOPMENT

The invention was made under government support under contract no. N00019-04-C-0014 awarded by the Naval Air Systems Command. The government has certain rights in the invention.

BACKGROUND

Frangible collar fasteners are commonly used in a variety of applications such as aircraft and aerospace applications. The frangible collar fasteners include a bolt engaging portion which is threadably engageable to a bolt, and a frangible nut portion which facilitates tightening of the bolt engaging portion to the bolt. The frangible nut portion is designed to break off from the fastener after it has been tightened to a defined torque. As a result, the bolt engaging portion remains secured to the bolt and the separated nut portion can drop to the surrounding work area, or otherwise fall as debris into the structure being constructed. Where the structure includes areas of limited access, such as a wing box or other confined space, it may be difficult to recover the nut portions after they become separated from the fastener. Given the potential harm that such loose debris can cause to mechanical systems, avionics systems, weapons systems, fuel systems and the like, it is imperative that such debris is not allowed to remain loose within the structure.

The present invention is directed to an apparatus used in conjunction with power tools for tightening frangible collar fasteners and collecting the separated portions of the fasteners in a reliable manner that avoids introduction of debris into the work area. The present invention is engageable to a powered offset ratchet head to capture a plurality of separated nuts. The apparatus includes a receiving aperture, disposed adjacent to the powered offset ratchet head, to receive the nuts separated from the frangible collar fastener. The nuts may be collected in the shroud and/or communicated through the shroud to a discharge port. A vacuum source connected to the shroud discharge port, is operative to draw the separated nuts from the shroud to a remote location for collection. Alternatively, the shroud may be connected to a pressure source, connected to the shroud adjacent an interior surface formed to create a venturi effect within the shroud.

The venturi effect is operative to urge the separated nuts towards and out of the discharge port. The invention allows a plurality of frangible collar fasteners to be tightened without interrupting the production process to manually collect the separated fasteners. As a result, the invention provides a reliable apparatus for collecting the separated nut portions of frangible collar fasteners in an efficient manner that enhances products safety and allows for improved production rates.

Further details of the invention are set forth below and described in connection with the accompanying drawings.

BRIEF SUMMARY OF THE INVENTION

A vacuum shroud is provided for receiving nuts separated from frangible collar fasteners by use of a powered offset ratchet head. The shroud comprises of an offset ratchet head receiving portion and a nut receiving portion. The offset ratchet head receiving portion defines an aperture formed to receive and engage the offset ratchet head. The nut receiving portion defines a nut receiving aperture. The nut receiving aperture is disposed adjacent the offset ratchet head receiving aperture, to receive nuts discharged from the offset ratchet head when the ratchet head is disposed in the ratchet head receiving aperture. In the preferred embodiment, the shroud further comprises a conduit extending from the nut receiving portion to the nut discharge port. The nut discharge port is engageable to a vacuum source to draw nuts received in the nut receiving portion out of the nut discharge port.

In one embodiment, the nut receiving portion defines a sloped surface for directing nuts entering the nut receiving aperture towards the nut discharge port.

In another aspect of the invention, the offset ratchet head receiving aperture is formed to secure the offset ratchet head in abutting relation to the nut receiving portion.

In one embodiment, the nut receiving portion defines an upper exterior surface that substantially conforms to at least one portion of the offset ratchet head.

The offset ratchet head may be formed to define an offset ratchet head discharge port, the offset ratchet head discharge port being disposable adjacent to the nut receiving aperture.

The shroud may also be formed to define an archway extending adjacent to the nut receiving portion to the offset ratchet head receiving portion, the archway facilitating engagement of the shroud to the offset ratchet head.

BRIEF DESCRIPTION OF THE DRAWINGS

FIG. 5A is a top view of the shroud;

FIG. 5B is a rear view of the shroud;

FIG. 5C is a right side view of the shroud;

FIG. 5D is a bottom view of the shroud;

FIG. 5E is a rear sectional view of the shroud;

FIG. 5F is a side sectional view of the shroud;

DETAILED DESCRIPTION

The presently referred embodiment of the invention is described below in connection with the drawings. However, it must be understood that other embodiments may be implemented without departing from the sprit and the scope of the invention, as set forth in the accompanying claims.

Figure 1:
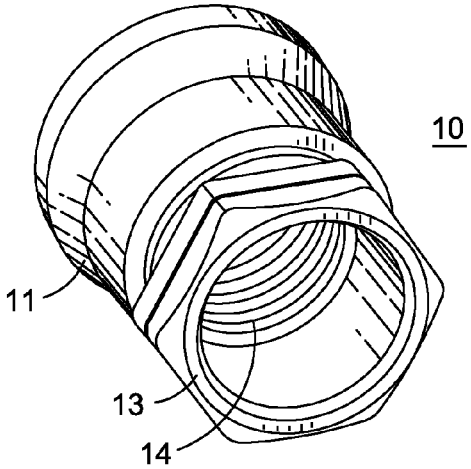
Fig. 1 (Prior Art)
FIG. 1 is a perspective view of an exemplary frangible collar fastener, including an inner bolt engaging portion and an outer frangible nut portion.

Referring to FIG. 1, an exemplary frangible collar fastener 10 is shown. The fastener 10 includes a bolt engaging collar 11 and nut 13. The bolt engaging collar 11 defines internal grooves 14 for receiving and engaging a bolt.

Once the bolt engaging collar 11 is tightened to the bolt to a predetermined torque, further tightening causes nut 13 to separate from the bolt engaging collar 11. Given the applications for which frangible collars are utilized, separated nuts and other loose debris may be highly problematical, yet difficult to capture with precision given the contained environments where the present invention can find application.

Figure 2:
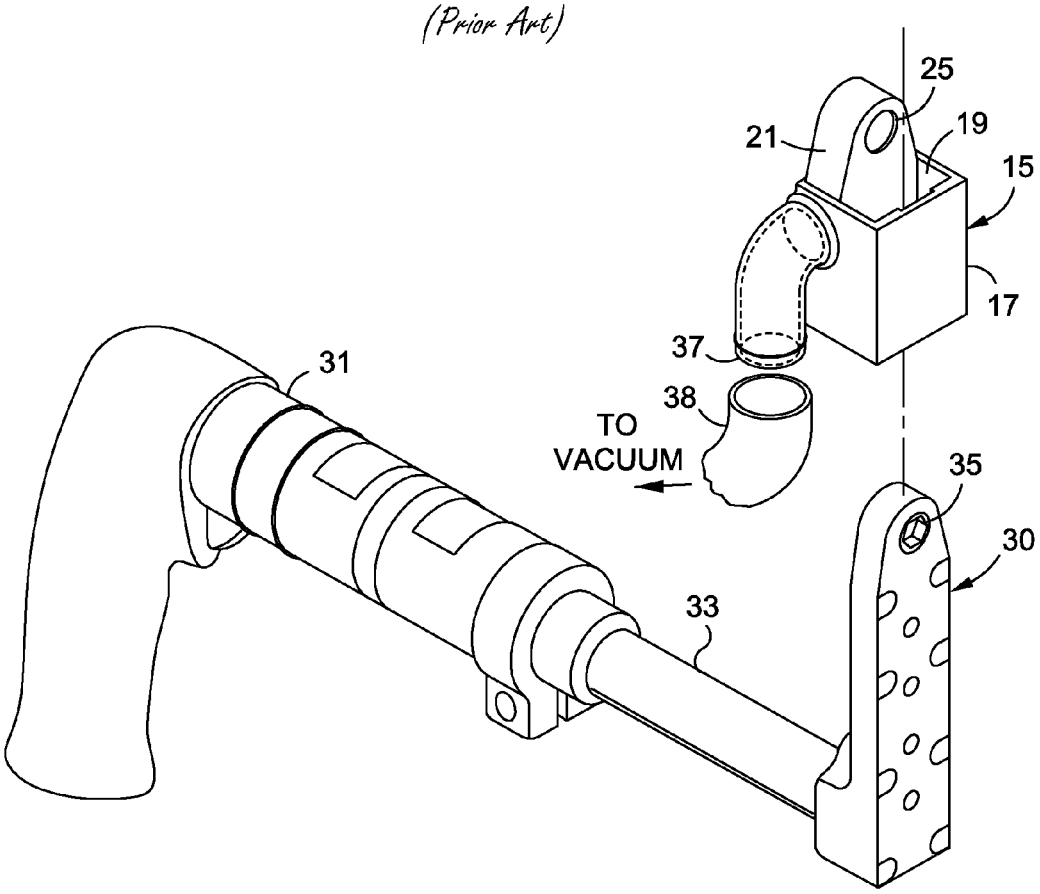
FIG. 2 is a perspective view showing a shroud in accordance with the present invention in association with a power tool and an offset ratchet head.

FIG. 2 illustrates a frangible collar tightening apparatus including power tool 31, rotating shaft 33 and offset ratchet head 30. Offset ratchet head 30 is slidably engageable to vacuum shroud 15, formed in accordance with the present invention. In operation, power tool 31 drives rotating drive 33 which, in turn, rotates nut receiving aperture 35, formed to receive and engage nut 13.

Figure 6:
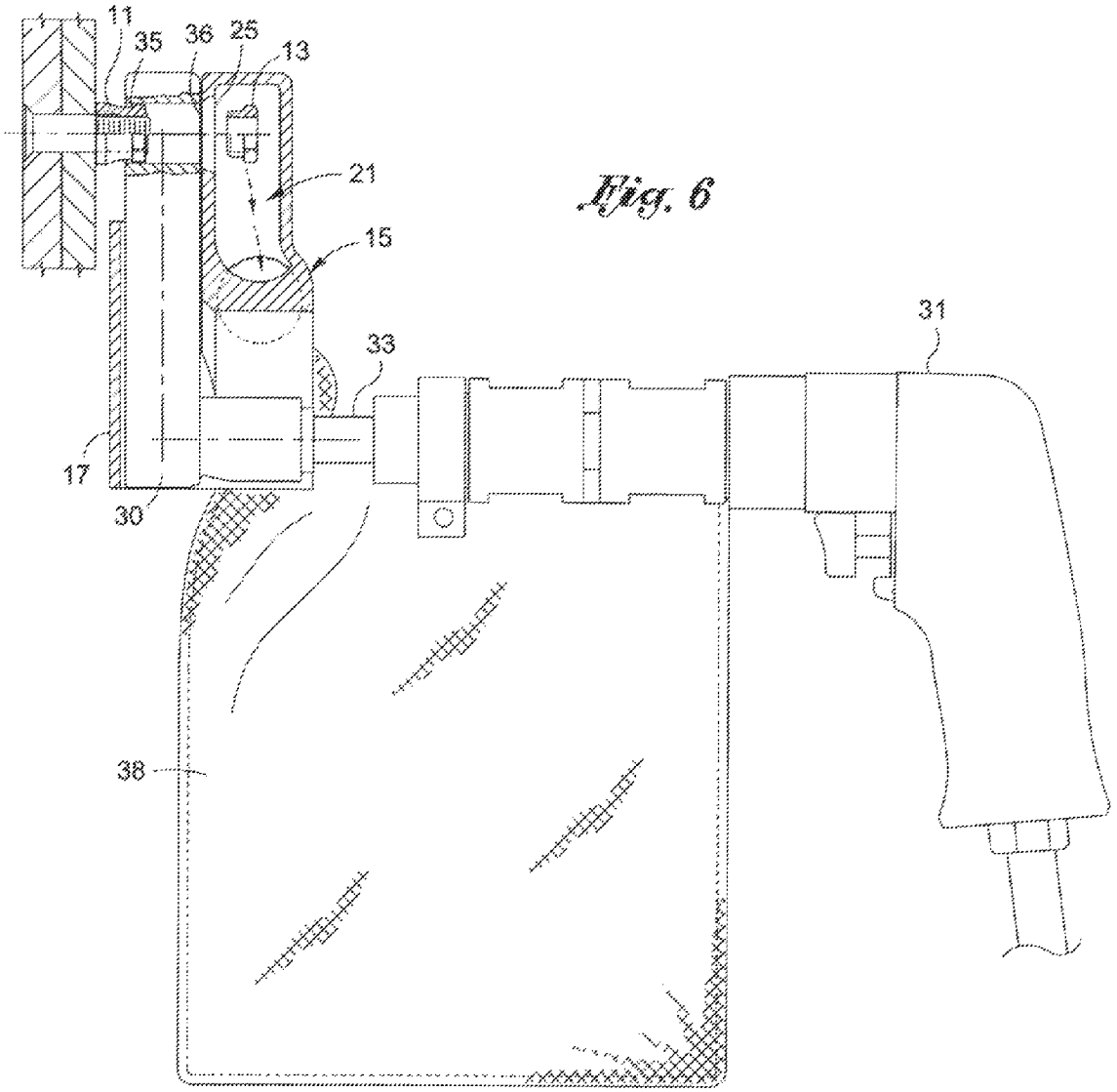
FIG. 6 is a side view showing the shroud in engagement with the offset ratchet head to receive and communicate a nut from the frangible collar fastener.
Figure 7D:
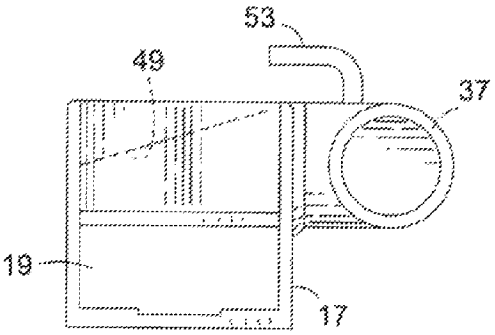
FIGS. 7A-7F are views of an alternate construction of the shroud.
Figure 7F:
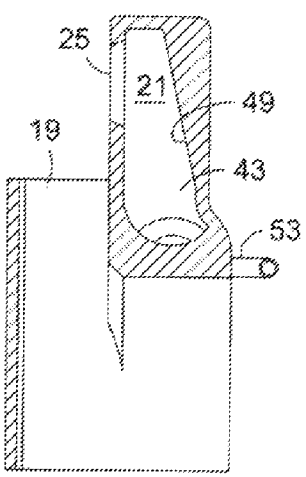
Figure 7E:
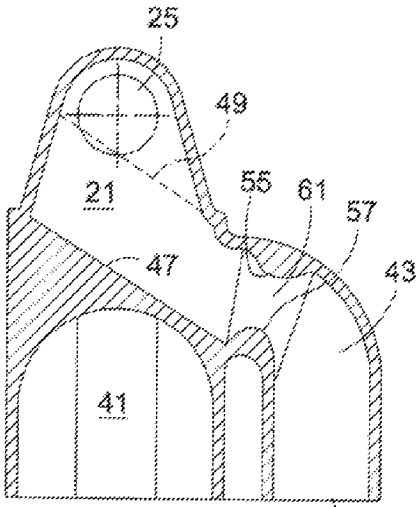
Figure 7C:
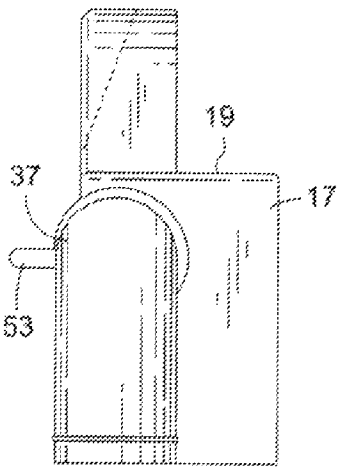
Figure 7A:
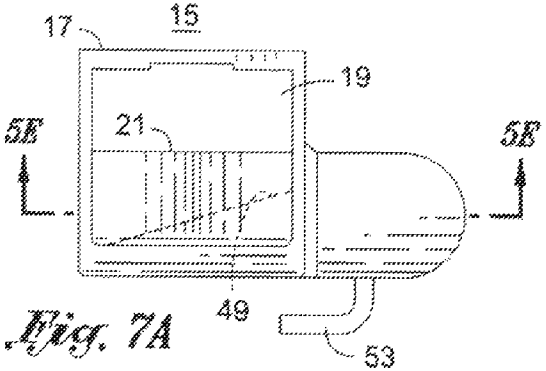
Figure 7B:
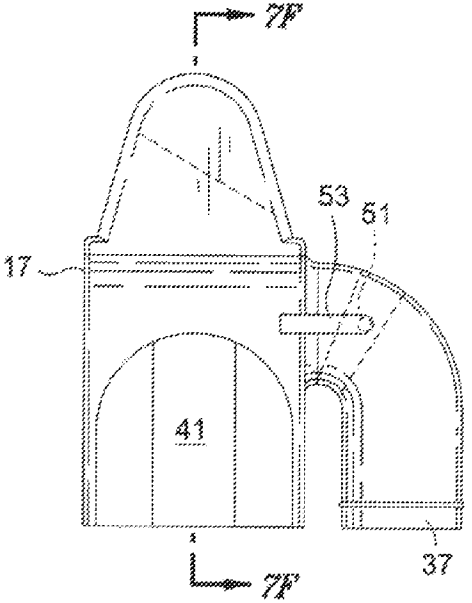

FIG. 6 illustrates shroud 15 engaged to offset ratchet head 30. As shown at FIG. 6, once the nut 13 is separated from collar 11, the nut 13 is communicated through nut receiving portion 21 under vacuum pressure and discharged from the ratchet head 30 through ratchet head discharge port 36. The separated nuts may be collected in a collection bag 38, directly connected to the discharge port 36, or communicated to a remote location for collection.

Figure 4A:
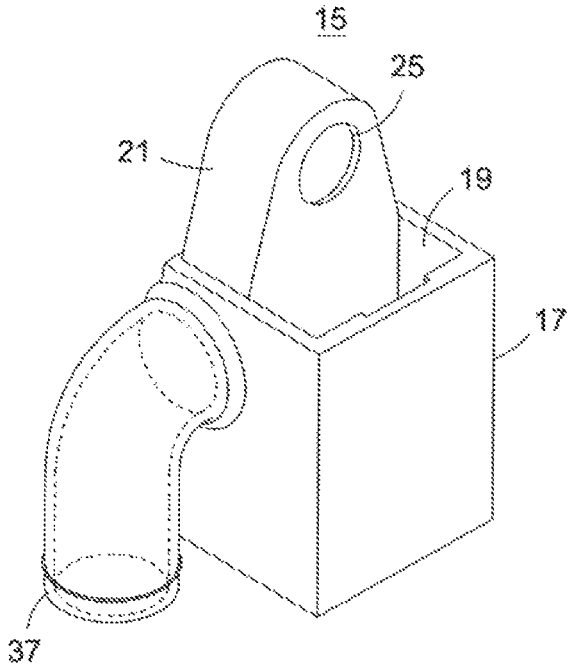
FIG. 4A is a front perspective view showing the shroud by itself.
Figure 4B:
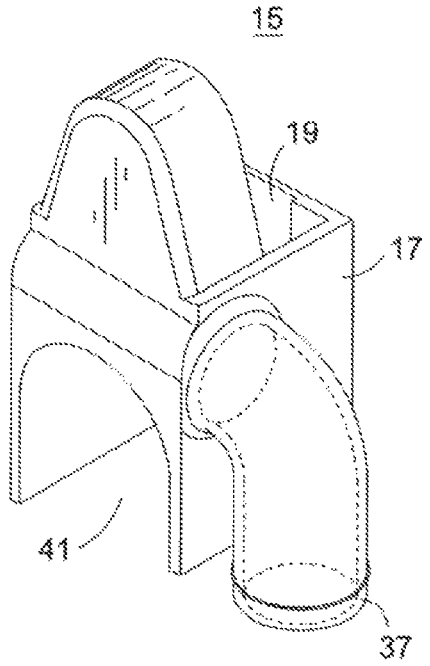
FIG. 4B is a rear perspective view showing the shroud by itself.

FIGS. 4A and 4B are perspective views of the shroud 15 prior to engagement with the offset ratchet head 30. FIGS. 5A-5F are plan views of the shroud 15 from different directions. Shroud 15 is preferably formed such that the offset ratchet head receiving portion 17 slidably engages the offset ratchet head 30. Shroud 15 defines an offset ratchet head receiving portion 17 and a nut receiving portion 21 (shown in more detailed at FIGS. 5A-5F). The offset ratchet head receiving portion 17 defines an aperture 19 formed to slidingly receive and engage the offset ratchet head 30. The nut receiving portion 21 defines a nut receiving aperture 25. Shroud 15 further defines a nut discharge port 37 and conduit 43 (shown at FIGS. 5E-5F), extending from nut receiving aperture 25, of nut receiving portion 21, to nut discharge port 37. The nut 13 enters the nut receiving portion 21 through nut receiving aperture 25. As shown at FIG. 6, nut receiving aperture 25 is disposed in axial alignment with frangible collar 11, to receive nuts discharged from the offset ratchet head 30. With the vacuum applied to the nut discharge port 37, the nut 13 is drawn through conduit 43 (shown at FIG. 5E) to discharge port 37.

In one construction, surface 47 may be substantially flat to allow separated nuts to collect in the shroud, and be collectively communicated from the shroud when a vacuum is applied to the nut discharge port 37. In another construction the nut receiving portion 21 may be implemented to define a sloped surface 47 (shown at FIG. 5E) for directing nuts from the nut receiving aperture 25 toward the nut discharge port 37.

FIGS. 7A-7F show views of an alternate construction of the shroud to include sloping surface 49, formed within the shroud nut receiving portion 21 opposite nut receiving aperture 25. The sloping surface 49 functions to mitigate nut stacking within the nut receiving portion 21.

Also shown at FIGS. 7A-7F is a conduit 53 which communicates a pressurized air to shroud 15 through port 51. Port 51 may be disposed adjacent protrusions to 55, 57 format along conduit 43 proximate the intersection of nut receiving portion 21 and conduit 43. The protrusions 55 and 57 are shaped to facilitate the creation of a venturi effect within the shroud 15 when air pressure is applied thru conduit 53. The venturi effect functions to create a vacuum within the shroud 15 to facilitate the extraction of nuts from the shroud 15, through discharge port 37, to an attached collection bag or to a remote collection area.

Figure 8:
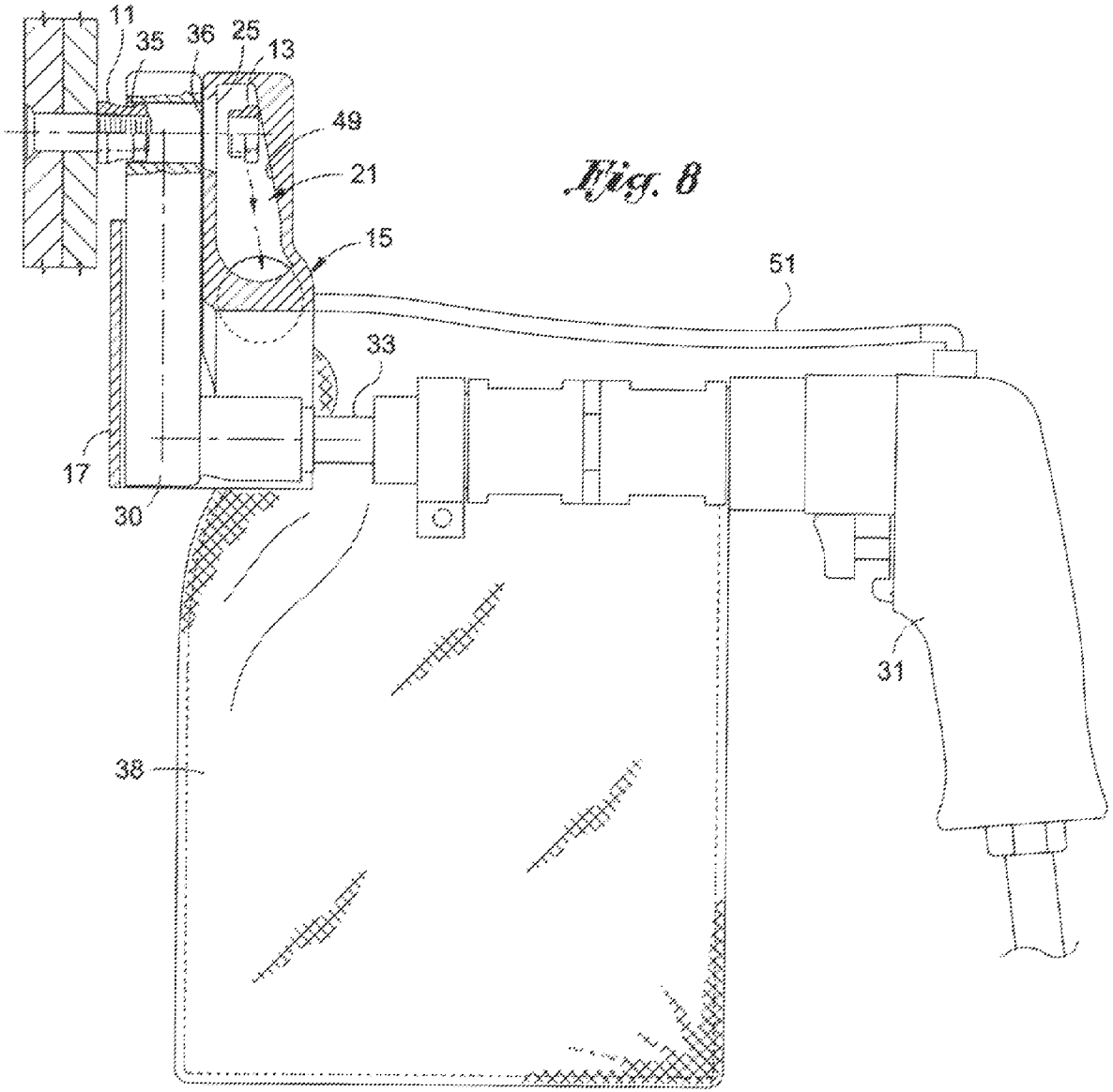
FIG. 8 is a side view showing the shroud in an engagement with the offset ratchet head in association with the power tool and a parasitic vacuum line.

FIG. 8 illustrates a frangible collar tightening apparatus, as shown in FIG. 6, further including conduit 53, which communicates pressurized air to shroud 15, as shown in FIGS. 5A-5F and 7A-7F. As noted above, the air pressure may be communicated to the shroud through port 51 and may be used to create a venturi effect within the shroud, i.e. within the conduit. The vacuum is operative to facilitate the extractions of nuts from the shroud 15 through shroud discharge port 37 to an attached collection bag, or to a remote collection area. In one embodiment the power tool 31 functions as a pressure source for generating a vacuum within the shroud 15.

As well it would be apparent to those with ordinary skills, the pressurized air is used to create the venturi effect may be generated by means other than by the operation of the power tool 31. A separate pressurized air source may be used to create the venturi effect within the shroud 14, or a vacuum may be drawn from parasitic operation of a pneumatic device, such as power tool 31, used within the area where the shroud 15 finds application. Where pressurized air is used to create a vacuum within the shroud, it may be unnecessary to apply a separate vacuum to the shroud discharge port.

The shroud 15 may further define an archway 41, formed proximate the nut receiving portion 21 and extending to the aperture 19, as shown at FIGS. 4B, 5B, and 5E.

Figure 3A:
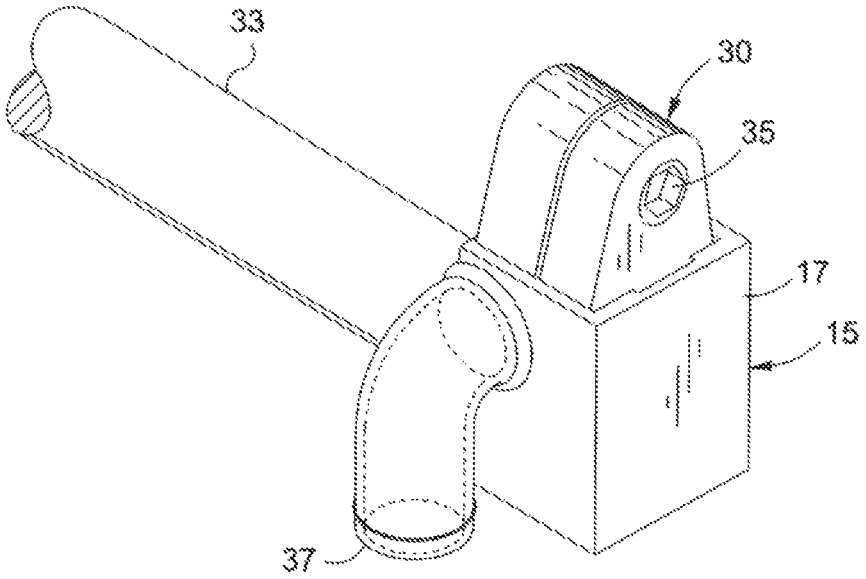
FIG. 3A is a front perspective view showing the shroud engaging the offset ratchet head.
Figure 3B:
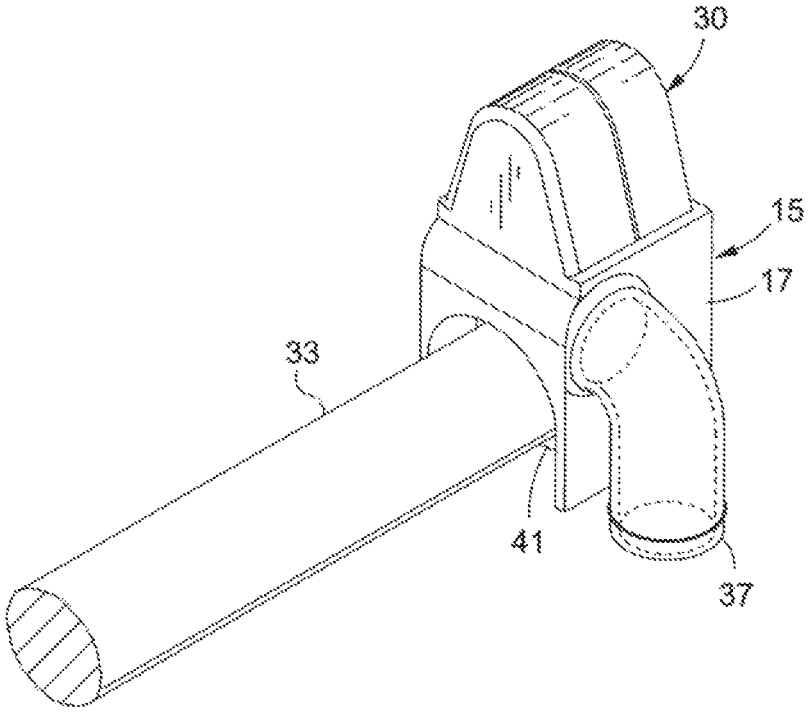
FIG. 3B is rear perspective view showing the shroud engaging an offset ratchet head.

FIGS. 3A and 3B show perspective views of the shroud 15 engaged to ratchet head 30, with archway 41 straddling the rotating shaft 33. Alternatively, as shown at FIG. 6 the archway 41 accommodates, or straddles, the base portion of the offset ratchet head 30, to facilitate engagement of the shroud to the offset ratchet head.

Numerous commercial devices may be used to apply a vacuum to discharge port 37. One such device is the 1620 series vacuum cleaner marketed by Magnavon. The device is light weight, easy to handle, and draws debris to an attached debris bag wherein the separated nuts may collect from later disposal.

The above description is given by way of example, and not limitation. Given the above disclosure, one skilled in the art could devise variations that are within the scope and spirit of the invention disclosed herein, including various alternate constructions for receiving, storing, and/or communicating the separated nuts to a remote collection area. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A vacuum shroud for receiving nuts separated from a frangible collar fastener by an offset ratchet head, the shroud comprising:

an offset ratchet head receiving portion and a nut receiving portion;

the offset ratchet head receiving portion defining an offset ratchet head receiving aperture formed to receive the offset ratchet head;

the nut receiving portion defining a nut receiving aperture, the nut receiving aperture being disposed adjacent the offset ratchet head receiving aperture and positioned to receive nuts discharged from the offset ratchet head;

the nut receiving portion defining a nut discharge port;

a conduit extending from the nut receiving portion to the nut discharge port; and the nut discharge port being connectable to a source of pressurized air to create a venturi effect within the conduit to facilitate the discharge of nuts out of the nut discharge port.

2. The shroud as recited in claim 1 wherein the nut receiving portion defines a sloped surface for directing nuts entering the nut receiving aperture towards the nut discharge port.

3. The shroud as recited in claim 1 wherein the offset ratchet head receiving aperture is formed to secure the offset ratchet head in substantially abutting relation to the nut retrieval portion.

4. The shroud as recited in claim 1 wherein the offset ratchet head defines an offset ratchet head discharge port, the offset ratchet head receiving aperture being formed such that the offset ratchet head discharge port is disposable adjacent to the nut receiving aperture.

5. The shroud as recited in claim 1 further comprising an archway extending adjacent the nut receiving portion to the offset ratchet head receiving aperture, the archway facilitating engagement of the shroud to the offset ratchet head.

6. The shroud as recited in claim 1 wherein the nut discharge port is engageable to a vacuum source to draw nuts received in the nut receiving portion out of the nut discharge port.

7. The shroud as recited in claim 1 wherein the source of pressurized air is a power tool operative to generate a parasitic supply of pressurized air.

8. An offset ratchet head shroud for receiving and communicating nuts separated from a frangible collar fastener by the offset ratchet head, the shroud comprising:

an offset ratchet head receiving aperture;

a nut receiving portion for receiving nuts separated from a frangible collar fastener by the offset ratchet head, the nut receiving portion defining a nut receiving aperture for receiving nuts separated from the frangible collar fastener;

a nut discharge port in communication with the nut receiving portion for communicating nuts separated from the frangible collar fastener to a remote location;

a conduit extending from the nut receiving aperture to the nut discharge port; and;

the nut discharge port being connectable to a source of pressurized air directed within the conduit to create a venturi effect within the conduit to facilitate the discharge of nuts out of the nut discharge port.

9. The shroud as recited in claim 8 wherein the offset ratchet head is disposable within the offset ratchet receiving aperture in adjacent relation to the nut receiving aperture.

10. The shroud as recited in claim 9 wherein the ratchet head receiving aperture is formed to slideably receive and engage the offset ratchet head.

11. The shroud as recited in claim 8 wherein the nut receiving portion defines a sloped surface for directing the nuts from the nut receiving aperture to the nut discharge port.

12. The shroud as recited in claim 8 wherein the nut receiving portion defines an arched passageway extending adjacent the nut receiving portion to the offset ratchet head receiving aperture, the passageway facilitating engagement of the shroud to the offset ratchet head.

13. The shroud as recited in claim 8 wherein the nut discharge port is connected to a vacuum source.

14. The shroud as recited in claim 8 wherein the source of pressurized air is a power tool.

* * * * *